United States Patent [19]

English

[11] 3,978,609

[45] Sept. 7, 1976

[54] AIRPLANE GAME APPARATUS

[75] Inventor: Robert English, Hollywood, Fla.

[73] Assignee: Lawrence Peska Associates, Inc., New York, N.Y. ; a part interest

[22] Filed: July 14, 1975

[21] Appl. No.: 595,668

[52] U.S. Cl. ..... 46/1 B; 46/1 H; 35/12 F

[51] Int. Cl.[2] ..... A63H 27/04

[58] Field of Search ..... 46/1 B, 1 H, 228, 243 MV; 35/12

[56] References Cited

UNITED STATES PATENTS

| | | | |
|---|---|---|---|
| 2,454,693 | 11/1948 | Foster | 46/1 H |
| 2,684,243 | 7/1954 | Alston | 46/1 H |
| 3,339,307 | 9/1967 | Floyd et al. | 46/243 M |
| 3,838,855 | 10/1974 | Becker | 46/1 H |

*Primary Examiner*—Louis G. Mancene
*Assistant Examiner*—Robert F. Cutting
*Attorney, Agent, or Firm*—Richard E. Nanfeldt

[57] ABSTRACT

An airplane game apparatus which simulates an airplane control panel is used for the entertainment of children. The game apparatus includes a housing having a control rod journalled for rotation therethrough. A model airplane is mounted on a pin journalled through the housing, wherein the pin and controlled rod are joined to each other by a connecting rod. A throttle rod extends through an aperture in the housing, wherein a plurality of first pulley are contained on the throttle rod within the housing. A plurality of dials are mounted on axle rods journalled for rotation through the housing. Second pulleys are mounted on each axle rod with the housing. A plurality of pulley belts communicate between the first and second pulleys.

4 Claims, 3 Drawing Figures

AIRPLANE GAME APPARATUS

BACKGROUND OF THE INVENTION

A number of U.S. Pat. Nos.: 3,526,043; 3,534,486; 3,702,504; and 3,831,172 have employed variously designed aviation trainer devices of complicated design which surpass the intelligence of a child for which my airplane game apparatus is specifically designed.

SUMMARY OF THE INVENTION

My present invention relates to a unique and novel airplane game apparatus which simulates a control panel of an airplane for the entertainment of children.

An object of my present invention is to provide an airplane game apparatus having a means for rotating an airplane model.

A further object of my present invention is to provide a means for rotating dials independently of each other by means of a control rod.

A still further object of my present invention is to provide a sound recording box for the game apparatus.

Briefly, my present invention comprises a housing having a control rod journalled for rotation therethrough. A model airplane is mounted on a pin journalled through the housing, wherein the pin and control rod are joined to each other by a connecting rod. A throttle rod extends through an aperture in the housing, wherein a plurality of first pulley are contained on the throttle rod within the housing. A plurality of dials are mounted on axle rods journalled for rotation through the housing. Second pulleys are mounted on each axle rod with the housing. A plurality of pulley belts communicate between the first and second pulleys.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
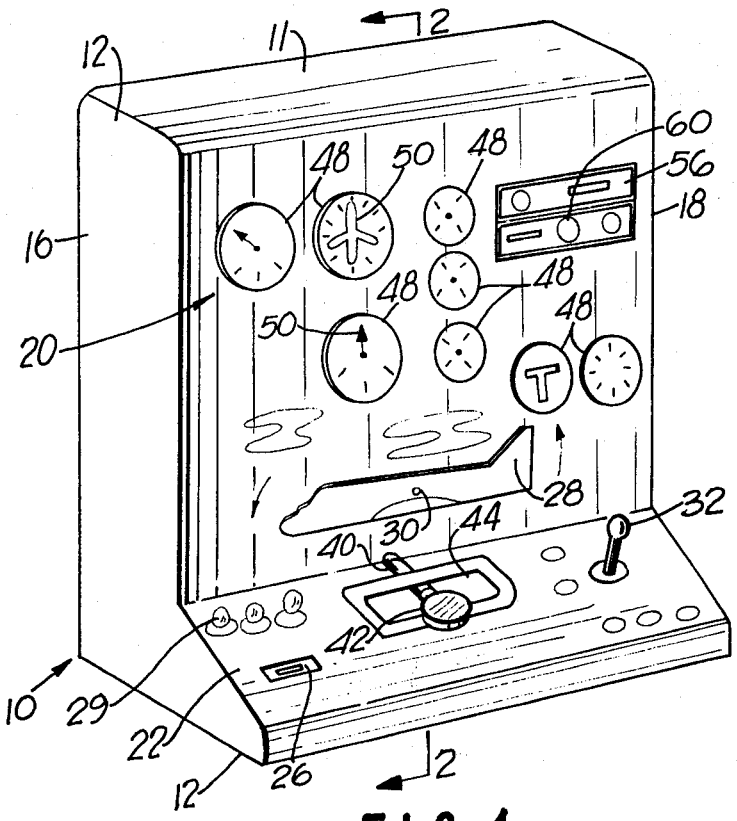
FIG. 1 illustrates a front perspective view of an airplane game apparatus.
Figure 2:
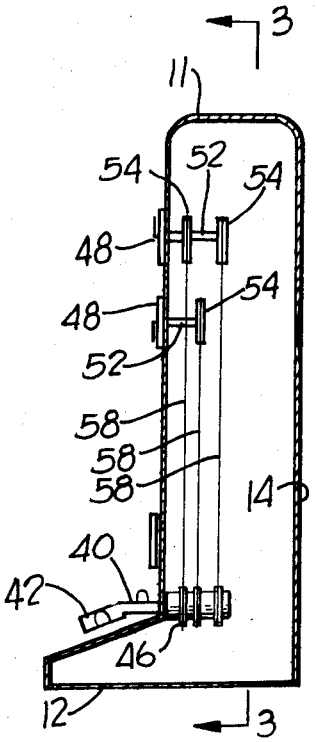
FIG. 2 illustrates an end cross sectional view of the airplane game apparatus taken along lines 2—2 of FIG. 1.
Figure 3:
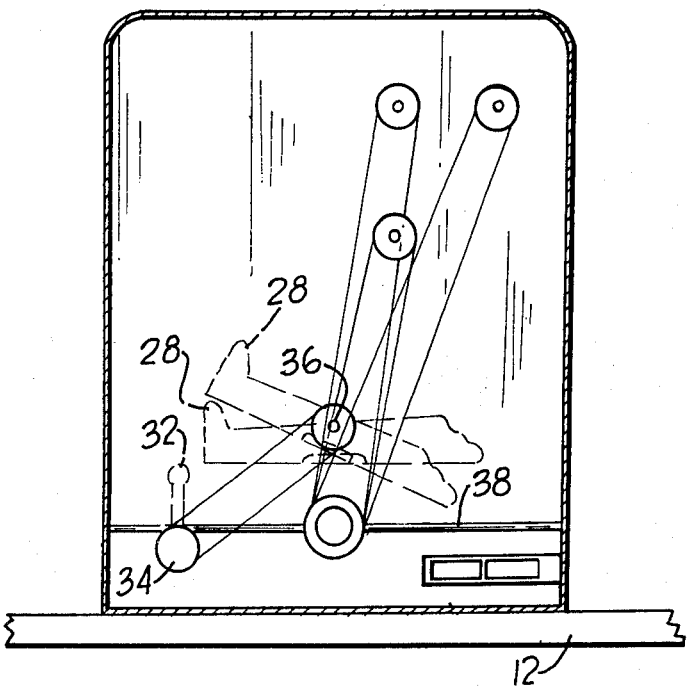
FIG. 3 illustrates a rear cross sectional view of the airplane game apparatus taken along lines 3—3 of FIG. 2.

Turning now descriptively to the drawings, in which similar reference characters denote similar elements throughout the several views, FIGS. 1–3 show an airplane game 10 which simulates an aviation panel of an airplane for use as a means of entertainment by a child. The game 10 comprises a housing 12 having a top 11, a base 12, a vertical rear wall 14, a pair of vertical sidewalls 16, 18, and a front wall consisting of an upper vertical section 20 and a lower section 22 extending outwardly from section 20 at an obtuse angle. Section 22 has a plurality of light bulbs 24 therein which are wired in a series circuit to an off switch 26 contained in section 22 and batteries contained with housing 12. An airplane model 28 is mounted on a pin 30 which is journalled for rotation through section 20. A control rod 32 is journalled for rotation through section 22. The inner ends 34, 36 of pin 30 and rod 32 are joined together by a connecting rod 38 within housing 12. When rod 32 is rotated, the airplane model 28 is rotated in a vertical plane. A throttle rod 40 having an outer end knob 42 extends outwardly through a rectangularly shaped aperture 44 in section 22. A plurality of first pulleys 46 are contained on the inner end of rod 40 within housing 12. A plurality of dials 48 having indicia 50 thereon are mounted on axle rods 52 journalled for rotation through section 20. Second pulleys 54 are mounted on the inner ends 56 of rods 52. A plurality of pulley belts 58 within housing 12 communicates between the first 46 and second 54 pulleys. When throttle rod 40 is moved left to right and turned within aperture 44, the dials 48 are caused to be rotated. A sound recording box 56 having a control button 60 therein is contained in section 20, wherein the box 56 emits sounds such as "ready for take-off."

Since obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. An airplane game, which comprises:

a. a housing having a base, a rear wall, a front wall, a pair of sidewalls, and a top, said front wall having a square aperture therethrough;

b. a control rod journalled for rotation through said front wall;

c. a model airplane mounted on a pin, said pin journalled for rotation through said front wall;

d. a connecting rod contained in said housing, said lever arm communicating between said control rod and said pin;

e. a throttle rod extending through a rectangularly shaped aperture;

f. a plurality of first pulleys mounted on said throttle rod within said housing;

g. a plurality of dials having indicia thereon, each said dial mounted on an axle rod journalled for rotation through said front wall;

h. a second pulley mounted on an inner end of each axle rod within said housing; and i. a pulley belt communicating between each said first and second pulley.

2. A game according to claim 1, wherein a sound recording box is contained in said housing.

3. A game according to claim 1, wherein a plurality of light bulbs wired in series to batteries and an on/off switch are mounted in said front wall.

4. A game according to claim 1, wherein said front wall includes an upper vertical section and a lower section extending outwardly from said upper section at an obtuse angle.

* * * * *